US007497711B2

(12) United States Patent
Gherardini et al.

(10) Patent No.: US 7,497,711 B2
(45) Date of Patent: Mar. 3, 2009

(54) MODULAR METHOD AND SYSTEM FOR INSULATED BUS BAR CABLE HARNESS TERMINATION CONCEPT

(75) Inventors: Stephen Daniel Gherardini, Harrisburg, PA (US); Christopher George Daily, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 3 days.

(21) Appl. No.: 11/625,633

(22) Filed: Jan. 22, 2007

(65) Prior Publication Data

US 2008/0173479 A1 Jul. 24, 2008

(51) Int. Cl.
*H01R 4/60* (2006.01)

(52) U.S. Cl. ..... 439/212; 439/210; 361/775; 174/72 B

(58) Field of Classification Search ..... 439/212, 439/213, 281, 282, 702, 620.21, 620.22, 439/487, 501, 502; 174/72 B; 361/775, 361/651

See application file for complete search history.

(56) References Cited

U.S. PATENT DOCUMENTS

| | | | | |
|---|---|---|---|---|
| 5,316,490 | A * | 5/1994 | Clemence et al. | 439/114 |
| 5,334,033 | A * | 8/1994 | Milan | 439/214 |
| 6,045,399 | A * | 4/2000 | Yu | 439/502 |
| 6,191,948 | B1 * | 2/2001 | Beyer | 361/729 |
| 2007/0072476 | A1 * | 3/2007 | Milan | 439/373 |
| 2007/0178756 | A1 * | 8/2007 | Schriefer et al. | 439/535 |

* cited by examiner

*Primary Examiner*—T C Patel
*Assistant Examiner*—Harshad C Patel

(57) ABSTRACT

A bridge and cable harness assembly to protect bus bar apparatuses from foreign object exposure and further, electrical shorts. The assembly provides an apparatus that is configured based on the specific arrangement of the bus bar. The user determined how many bridge assemblies are necessary to protect the bus bars. The bus bars and bridges are secured to each other either by apertures in bus bars that accepts protrusions of bridges which are heat staked, or where the bus bars are overmolded into the insulative bridge material. Screws are used to make a final assembly into the board-mounted connectors.

14 Claims, 12 Drawing Sheets

MODULAR METHOD AND SYSTEM FOR INSULATED BUS BAR CABLE HARNESS TERMINATION CONCEPT

BACKGROUND OF THE INVENTION

The present invention is directed to a modular solution of bringing power into a panel assembly bus bar while being insulated and also accommodating multiple configurations of bus bars.

Panel assembly bus bars typically are installed such that the entire length of the bus bar is exposed and not protected. The exposed bus bar creates the opportunity for a foreign object to fall across them and cause a short circuit, which may damage the bus bars as well as the panel assembly and other electrical equipment supported by the panel assembly.

One current system for preventing outside objects from contacting the bus bars places a covering across the entire panel. However, this covering does not prevent any objects from within the panel system from falling onto the bus bars and causing a short.

Therefore, what is needed is a type of protection for the bus bars that will prevent objects from contacting the bus bars, while providing a secure contact and adequate conductivity of the bars.

SUMMARY OF THE INVENTION

One embodiment of the present invention includes an apparatus for terminating a bus bar assembly having at least one bridge assembly with an insulative bridge component with a plurality of first apertures disposed along a top surface of the bridge assembly configured to receive a plurality of fasteners, a first plurality of bus bars partially recessed in the insulative bridge component and partially extending from at least one side surface, and a plurality of second apertures disposed along at least one side surface configured to receive a plurality of second bus bars. The apparatus also includes a cable harness assembly having an insulative harness component with a plurality of first apertures disposed along a top surface of the cable harness assembly and configured to receive a plurality of fasteners, a plurality of second apertures disposed on at least one side surface and configured to receive the first plurality of bus bars and a plurality of conductive wires extending from the insulative harness component. The first plurality of bus bars from the insulative bridge component engage with a plurality of apertures wherein the plurality of apertures is selected from the group consisting of the plurality of second apertures of the cable harness assembly and the plurality of second apertures of a second bridge assembly to create an electrically conductive circuit.

Another embodiment of the present invention includes an apparatus for terminating a bus bar assembly having a cable harness assembly with an insulative harness component, a plurality of conductive wires partially recessed within the insulative harness component, the wires having terminals on a bottom of the insulative harness component and extending from at least one side of the insulative harness component, a plurality of first apertures disposed along a top surface of the cable harness assembly for receiving a plurality of fasteners. The apparatus also includes at least one bridge assembly having an insulative bridge component, a plurality of first apertures along a top surface of the at least one bridge assembly for receiving fasteners, a plurality of insulative protrusions extending away from the at least one bridge assembly, a plurality of bus bars disposed on a bottom of the at least one insulative bridge component, the plurality of insulative protrusions securing the plurality of bus bars along the bottom of the at least one insulative bridge component. The at least one bridge assembly partially covers the plurality of bus bars and the cable harness assembly is configured to cover an exposed portion of the plurality of bus bars, wherein the plurality of bus bars contacts the terminals on the bottom of the insulative harness component to create an electrically conductive connection.

Yet another embodiment of the present invention includes an apparatus for terminating a bus bar assembly having a plurality of bus bars and a cable harness assembly having an insulative harness component, a plurality of conductive wires partially recessed within the insulative harness component having terminals on a bottom of the insulative harness component, the wires extending from at least one side of the insulative harness component, a plurality of first apertures disposed along a top surface of the cable harness assembly for receiving a plurality of fasteners. The cable harness assembly is configured to cover an exposed portion of the plurality of bus bars, wherein the bus bars contact the terminals on the bottom of the insulative harness component to create an electrically conductive connection.

Another embodiment of the present invention includes a method for an apparatus for terminating a bus bar assembly having the steps of providing at least one bus bar assembly, providing at least one insulating bridge assembly and securing the at least one bridge assembly to the bus bar assembly with a plurality of fasteners. The method also includes the steps of providing a cable harness assembly and securing the cable harness assembly to the bus bar assembly. The insulating cable harness assembly and the at least one insulating bridge assembly substantially shields the bus bar assembly.

One advantage of the present invention is the ability to provide power to a panel through a modular system.

Another advantage of the present invention is a provision of a multiple bus assembly, depending upon need.

Still another advantage of the present invention is that it permits use of over-molded cable harnesses to provide easy bolt-in assemblies.

Yet another advantage of the present invention is the ability to construct the bridges from either side of the assembly without damaging the wires.

Another advantage of the present invention is the variety of multiple positions made available.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Many types of electrical applications use bus bar assemblies to electrically connect various components and equipment. By design, these bus bar assemblies are typically exposed and are not protected from having foreign objects contacting them and either causing electrical shorts in the system or damaging the components and equipment. Bus bar assemblies can be used to conduct single phase or three-phase power to various electrical components. The present invention may be used with any application that requires the use of bus bar assemblies. In many applications, bus bar assemblies are exposed to foreign objects that may contact them and short the electrical connection and cause damage to the bus bars, and other equipment that is electrically connected to or in contact with them. Nothing is used to protect the bus bars from contacting an object and causing an electrical short.

Figure 1:
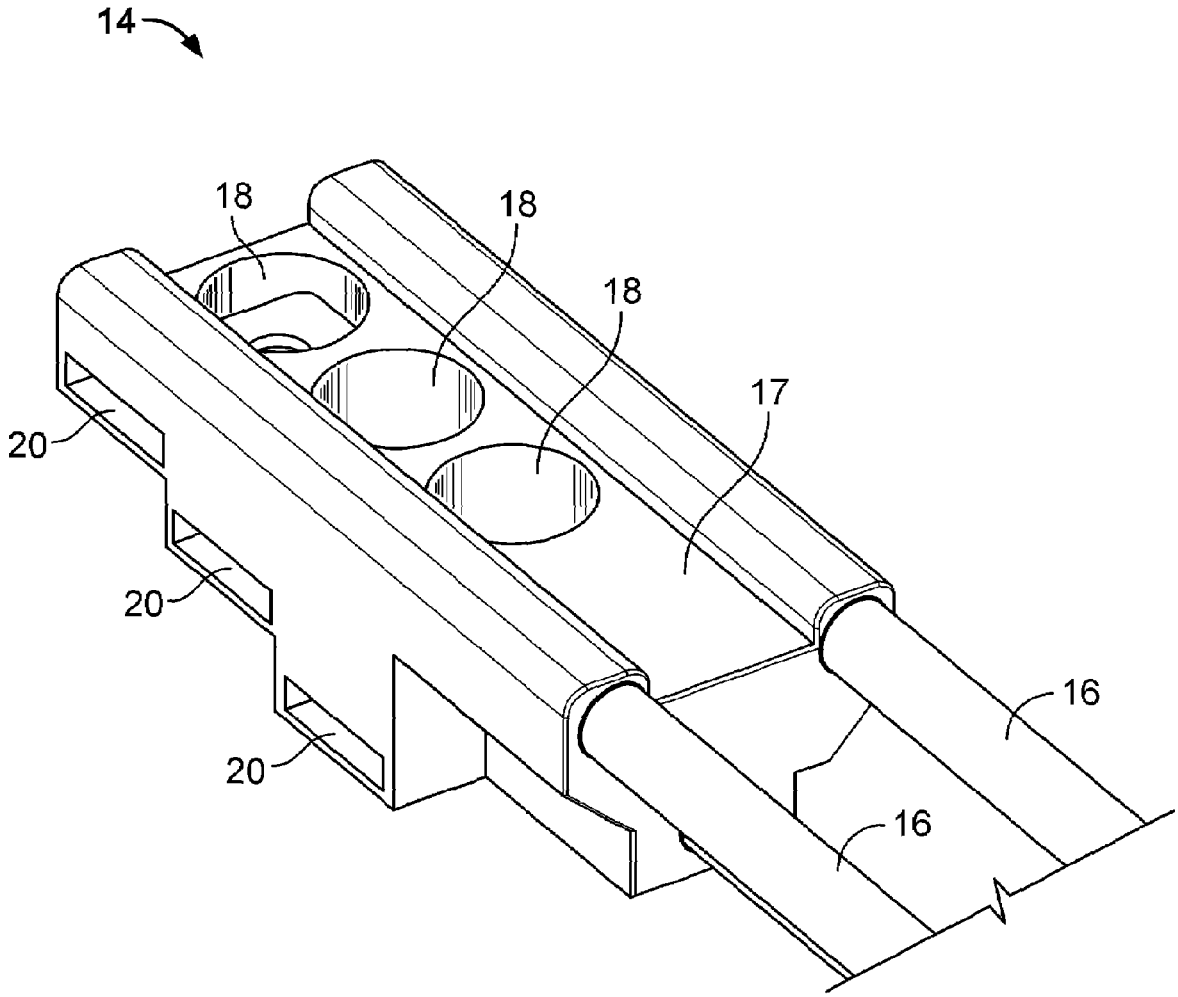
FIG. 1 illustrates the cable harness of the present invention.
Figure 2:
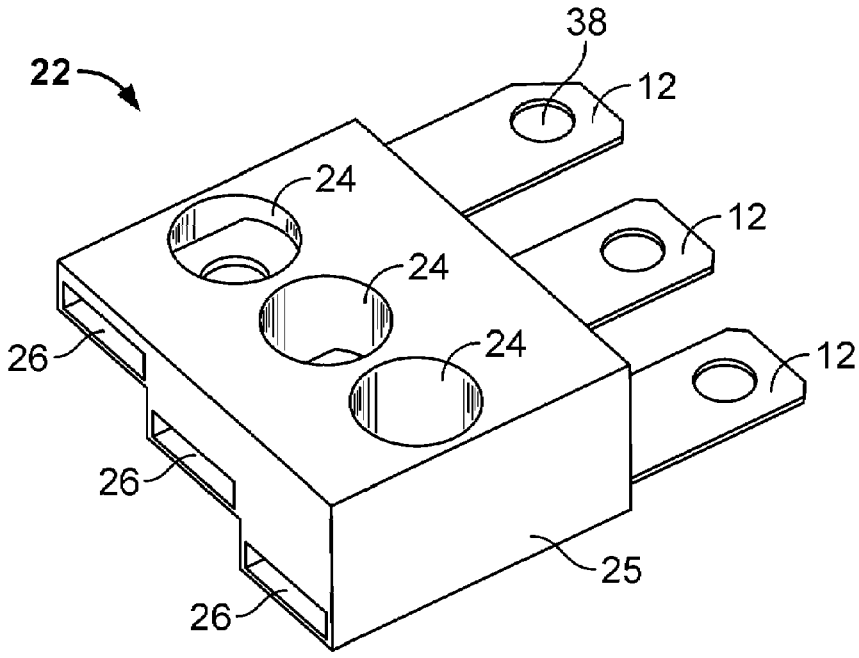
FIG. 2 illustrates the bridge assembly of the present invention.

FIG. 1 illustrates a portion of one embodiment of the present invention that protects the bus bar 12 from being contacted by an extraneous object and causing an electrical short when assembled. The cable harness assembly 14 is configured with wires 16 secured with a connection to terminals (not shown) inside the cable harness 14. The cable harness 14 has three apertures 18 which accommodate the insertion of screws (not shown) or other hardware. Three other apertures 20 are disposed along the side of the cable harness 14 that accommodate the insertion of the bus bars of the bridge assembly 22 illustrated in FIG. 2. The bridge assembly 22 also contains three apertures 24 that accommodate the insertion of screws (not shown) or other hardware. In addition, three bus bars 12 protrude from the bridge assembly 22, which mount into the apertures 20 along the side of the cable harness 14 (FIG. 1). The bridge assembly 22 also has apertures 26 along the opposite side of the bus bars 12 which accommodate the insertion of bus bars 12 from another bridge assembly 22, if necessary. The cable harness 14 (FIG. 1) and the bridge assembly 22 completely encapsulate the bus bars 12 and protect the bus bars 12 from contacting any foreign object that may cause an electrical short. Both the cable harness 14 (FIG. 1) and the bridge assembly 22 overmolds are manufactured from a non-conductive material capable of enduring high temperatures.

Figure 3:
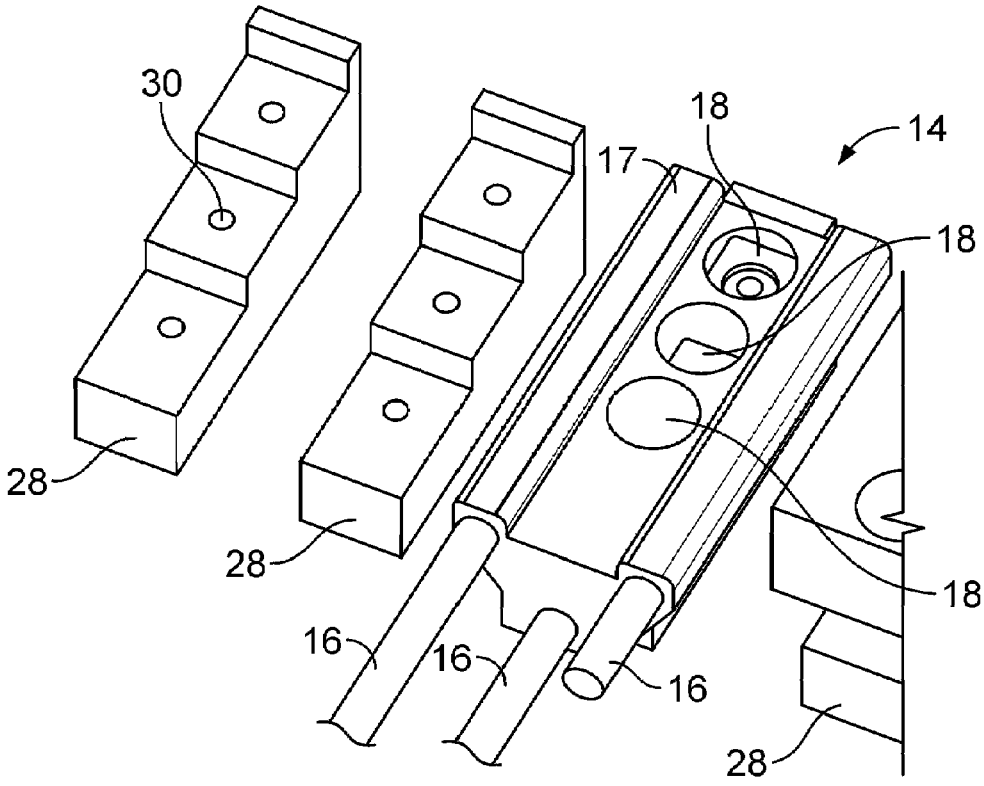
FIG. 3 illustrates the cable harness disposed on a board-mounted connector.
Figure 4:
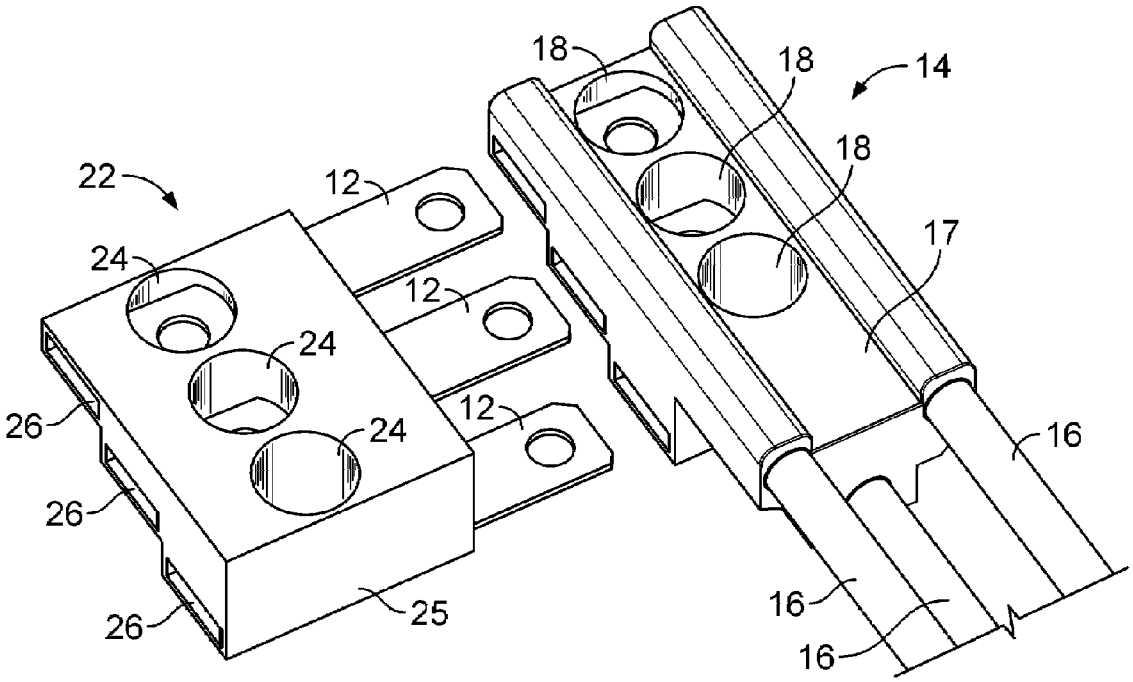
FIG. 4 illustrates the bridge assembly and the cable harness of the present invention.
Figure 5:
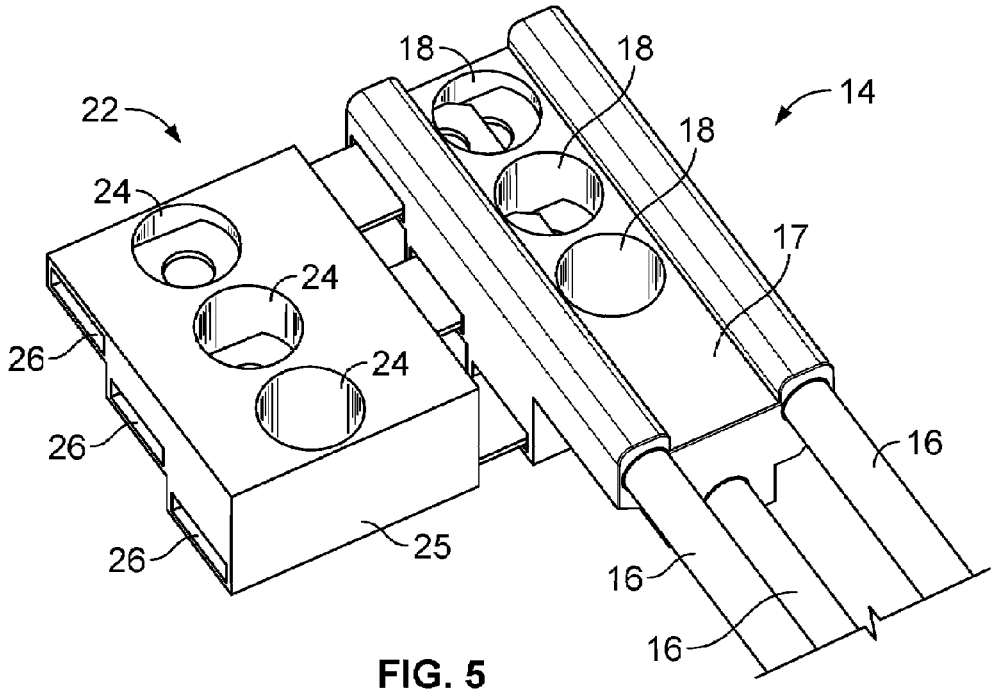
FIG. 5 illustrates the bridge assembly as partially assembled to the cable harness of the present invention.

FIG. 3 illustrates the cable harness 14 as disposed on a portion of the board-mounted connector 28. The cable harness 14 is designed to lie on conductive members of the board-mounted connector 28 such that the apertures 30 in the connector 28 align with the screw apertures 18 of the cable harness 14. The method of application of the cable harness 14 and bridge assembly 22 to the connector 28 shown in FIGS. 5 and 6 includes placing the cable harness 14 on the connector 28 (FIG. 3) and inserting the bus bars 12 of the first bridge assembly 22 into the side apertures 20 of the cable assembly 14 (FIG. 4). As the bus bars 12 are inserted into the side apertures 20 of the cable assembly 14, the apertures of the bus bar 38 align with the apertures 18 of the cable assembly 14 (FIG. 5). Next, screws (not shown) or other tools or equipment are inserted into the apertures 18 and make a secure connection between the bus bars 12, the terminals 56, and the connector 28, providing electrical contact and preventing inadvertent separation of bus bars 12, connector and cable harness 14.

Figure 6:
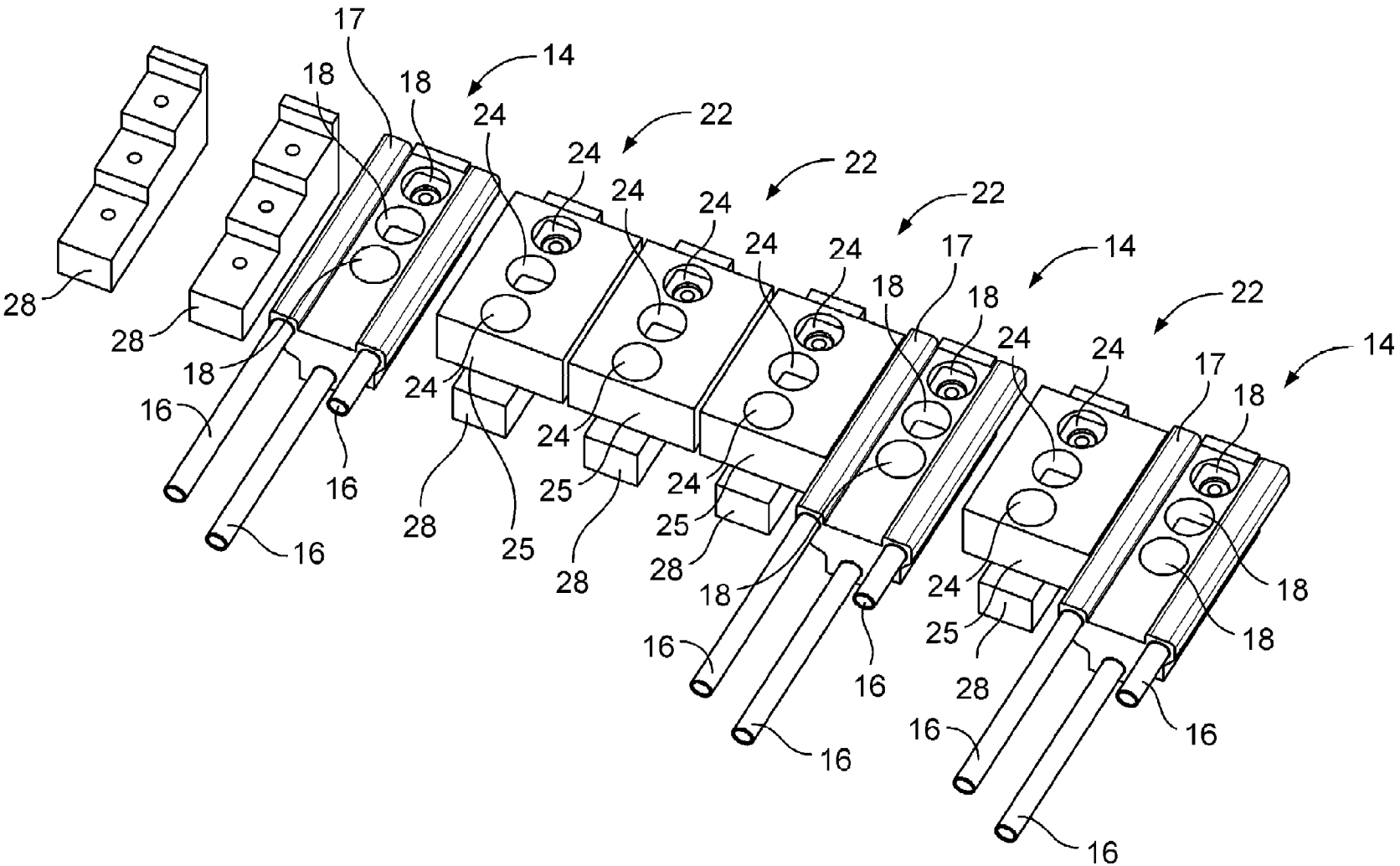
FIG. 6 illustrates a multiple bus bar termination of one embodiment of the present invention.

If more than one bridge assembly 22 is required, then after the first bridge assembly 22 is connected to the cable assembly, a second bridge assembly 22 is inserted into the first bridge assembly 22 as shown in FIG. 6. This insertion is performed in the same manner as the first bridge assembly 22 was inserted into the cable harness 14 in FIGS. 4 and 5. The bus bars 12 of the second bridge assembly 22 are inserted into the apertures 26 of the first bridge assembly 22 until the bus bar apertures 36 align with the screw apertures 24. Then a screw (not shown) or other tool is inserted into the aperture to secure the bridge assemblies 22 in place. As further shown in FIG. 6, there is no theoretical limit to the number of bridge assemblies 22 that can be inserted in series with one another, the physical limitations being provided only by the space limitations of the cabinet housing the bus bars. Also, though FIG. 6 shows a maximum of three bridge assemblies 22 connected to one cable harness 14, any number of multiple bridge assemblies 22 may be used in connection with one another. Further, as FIG. 6 shows, as few as one bridge assembly 22 may be used in connection with one cable harness 14, or a cable harness 14 may be used alone without a bridge assembly 22.

The cable harness 14 and bridge assembly 22 shown in FIGS. 1-6 preferably accommodate the use of up to six terminal connections, but are not limited to six connections. In addition, three bus bars 12 are shown in all Figures, however as few as one bus bar 12 may be used, and an infinite amount of a plurality of bus bars 12 may be used as well, subject to the limitations discussed above. The preferred application is for a three-phase, AC electrical application, however, a single phase, DC electrical application may also apply, as well as having multiple bus bars carrying different levels of current. For example, one bus bar may carry ten amperes, the second may carry twenty amperes, and the third may carry thirty amperes, however any configuration may be used. Also, the screw apertures are preferably designed to accommodate a screw, in which the screw head is recessed below the top surface of the cable harness 14 or bridge assembly 22. However, any type of tool or equipment capable of being conductive and fitting into the apertures 18, 24 may be used. The terminals 56 (FIGS. 16-18) are welded to the wires 16 and are preferably constructed of a copper alloy or C110 copper material, however, any type of electrically conductive material may be used for the terminals 56 or the wires 16 in the cable harness 14. After the wire terminal assemblies are assembled, they are overmolded, encapsulating them in a non-conductive material as discussed previously.

Figure 7:
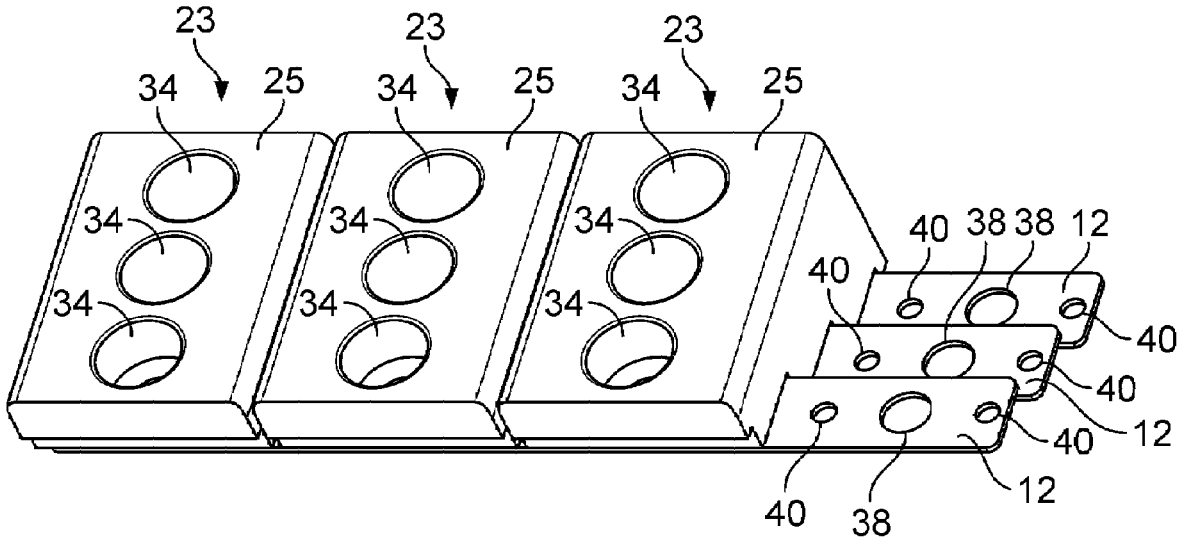
FIG. 7 illustrates a 4-position Bus Bar with molded bridges shifted left.
Figure 8:
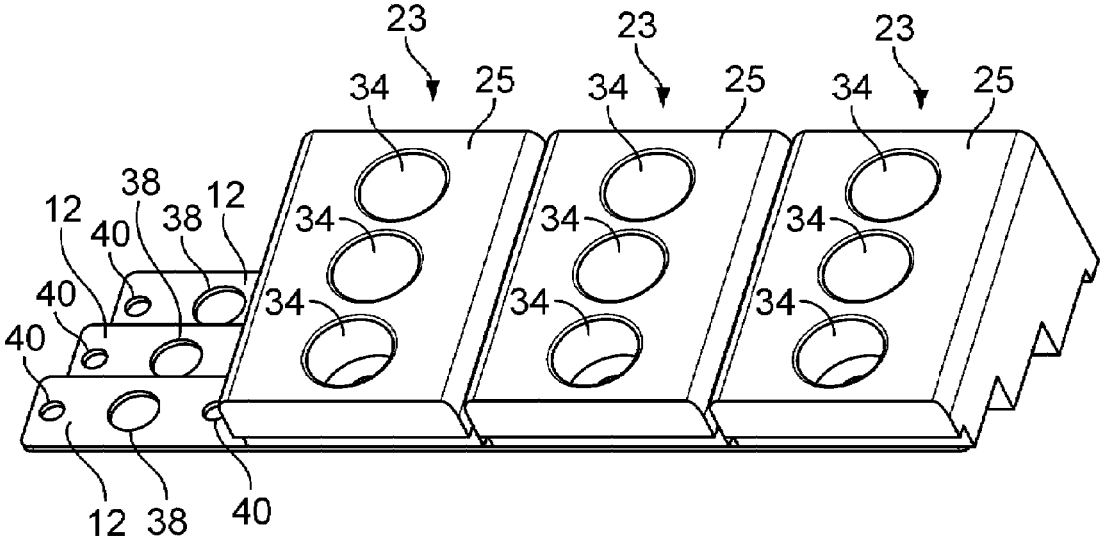
FIG. 8 illustrates a 4-position bus bar with molded bridges shifted right.

A preferred embodiment of the present invention is illustrated in FIGS. 7 and 8. This embodiment includes bus bars 12 that are not fully encompassed by a plastic enclosure as in the first embodiment. An insulative bridge component 25 is used that has three screw apertures 34 that align with the apertures 38 of the bus bar 12. It is to be understood that the insulative bridge component is manufactures from a plastic or other suitable insulative material. Preferably, Amodel® plastic, manufactured by Solvey Advanced Plymers is used. While FIGS. 7 and 8 illustrates the use of three bridge components 25 and three bus bars 12 to make a bridge assembly 23, as few as one bridge 25 may be used. Preferably, one to five bridge components 25 are used in an application, however, any number of bridge components 25 may be used. FIGS. 7 and 8 illustrate that the bridge components 25 may be assembled where the first bridge 25 is placed to the left-most end of the bus bar 12. The other remaining bridge 25 are then assembled to the right of the first bridge 25. FIG. 8 illustrates a bridge assembly 23 where the first bridge is placed to the right-most end of the bus bar 12. The other remaining bridges 25 are then assembled to the left of the first bridge 25. The preferred embodiment permits the arrangement of the bridge components 25 where the bridges 25 can be shifted either to the left, right or end positions as required, for maximum flexibility of the installation where the open position would accept cable assembly 14.

Figure 9:
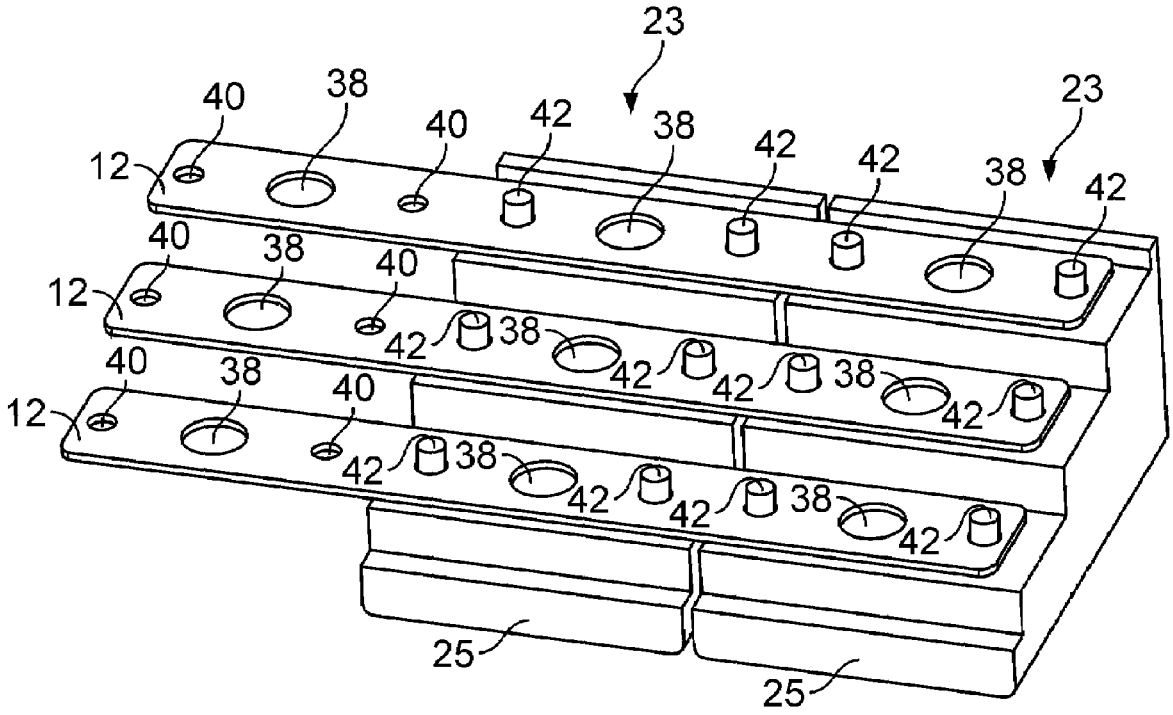
FIG. 9 illustrates a 3-position bus bar assembly prior to the heat stake.
Figure 10:
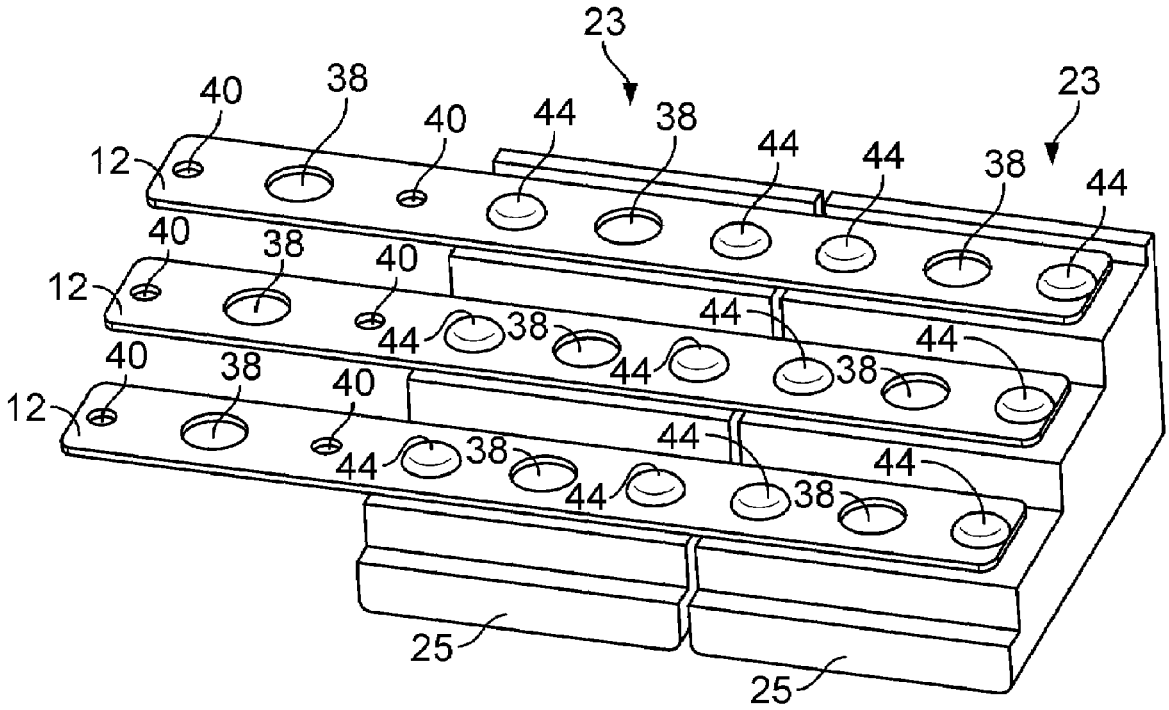
FIG. 10 illustrates the 3-position bus bar assembly of FIG. 9 after the heat stake.

FIG. 9 illustrates an underside view of the bridge assembly 23 prior to the final assembly of the present invention. The bus bars 12 are stamped having screw apertures 38 and protrusion apertures 40. The screw apertures 38 are sized such that a screw (not shown) or other fastener may fit through the aperture 38 to enable mounting in the application. The protrusion apertures 40 are sized such that the protrusions 42 on the bridge components 25 may fit through the apertures 40. The protrusions 42 are molded features of the bridge components 25 and are part of the unitary device of the bridge components 25, which is made from the same Amodel® plastic or other suitable insulative material as the bridge components 25. The protrusions 42 fit through the protrusion apertures 40 locating the bus bars 12 until a heat stake process is applied to the protrusions 42. During the heat stake, the portion of the protrusions 42 that rise above the bus bar 12 are formed into caps 44 that secure the bus bar 12 to the bridge components 25, thereby creating the bridge assembly 23, as shown in FIG. 10.

Figure 11:
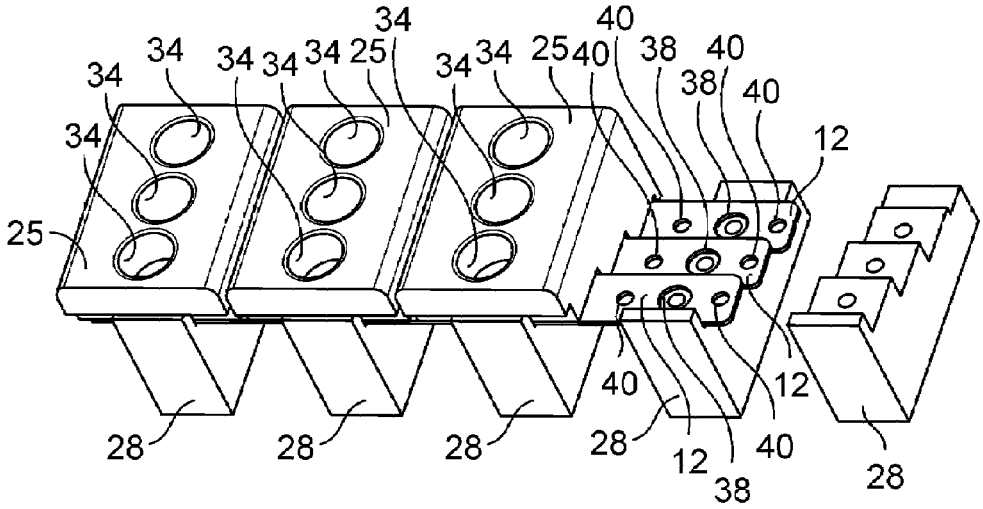
FIG. 11 illustrates the installation method of the bus bar assemblies.
Figure 12:
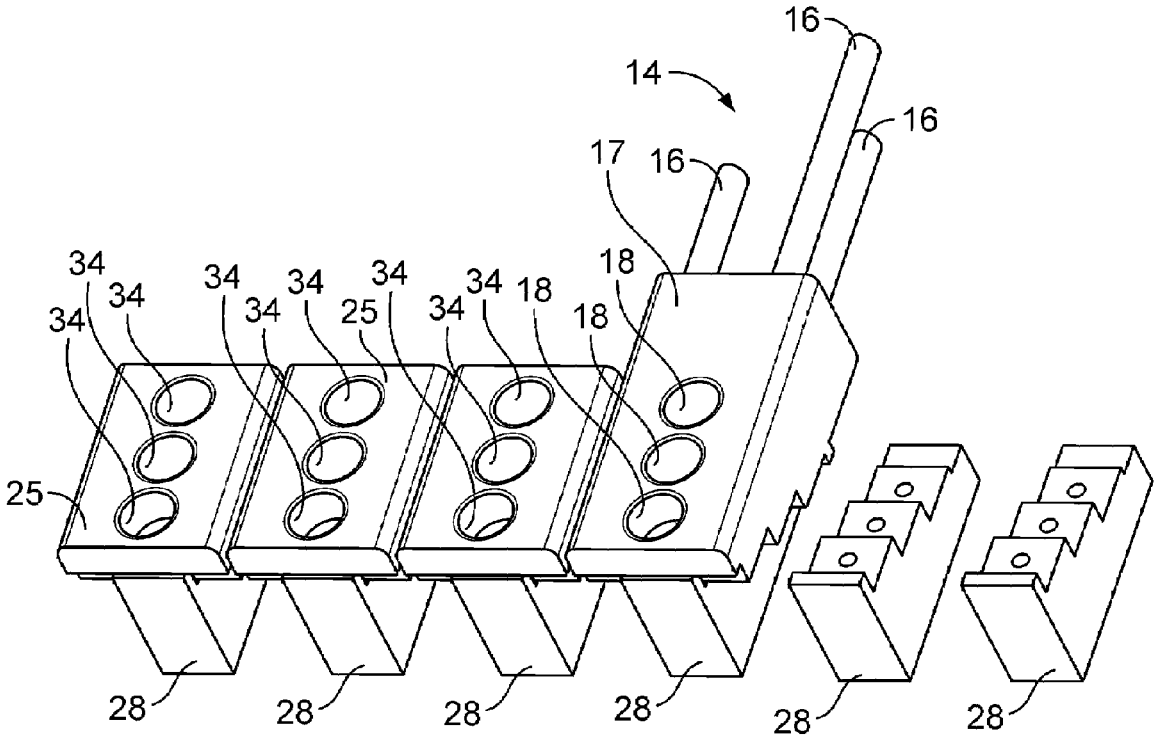
FIG. 12 illustrates the installation method of the bus bar assemblies where the cable harness assembly is installed.
Figure 13:
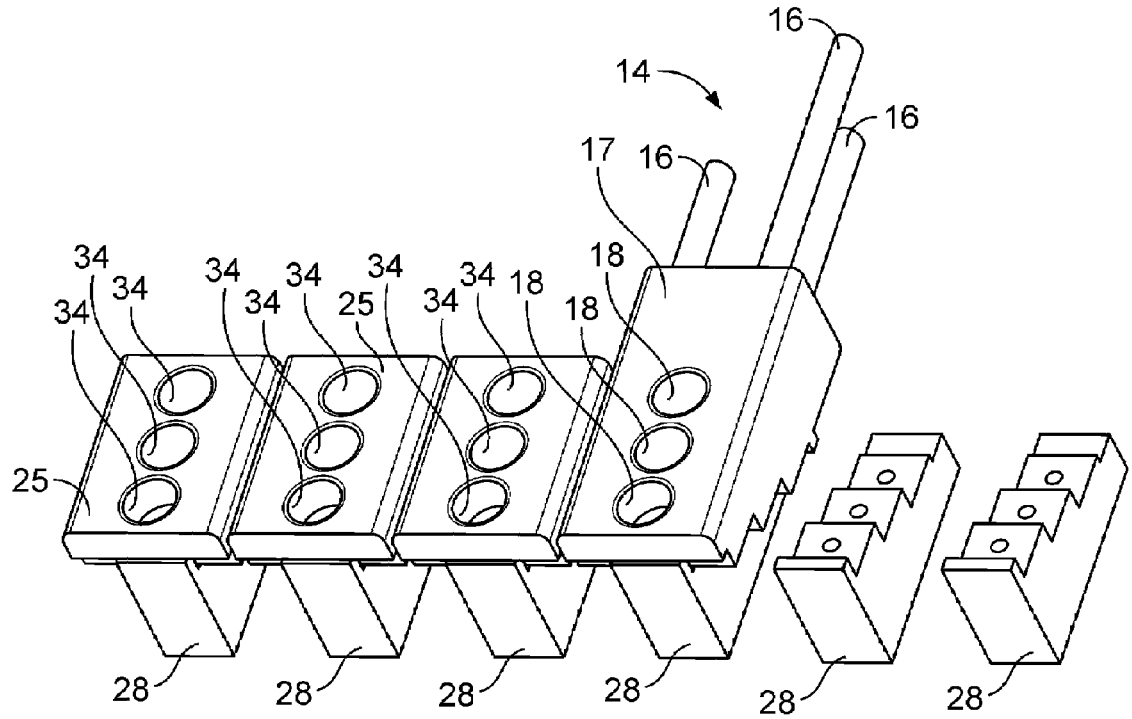
FIG. 13 illustrates the cable harness as installed to the right of the bridge assemblies.
Figure 14:
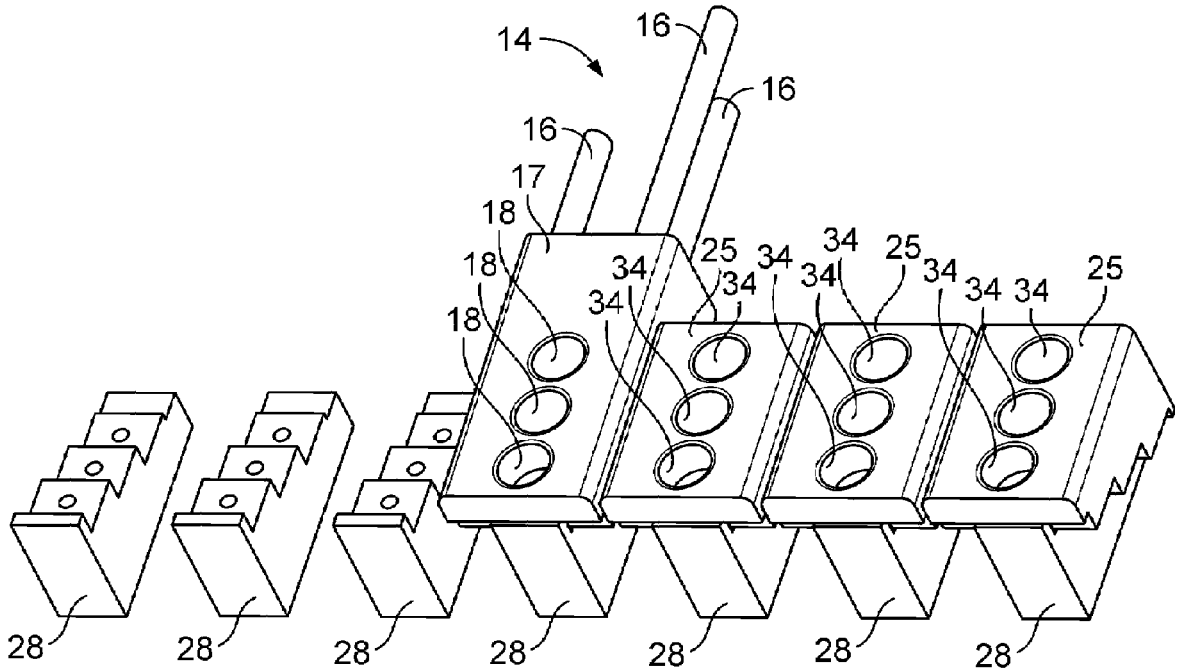
FIG. 14 illustrates the cable harness as installed to the left of the bridge assemblies.
Figure 23:
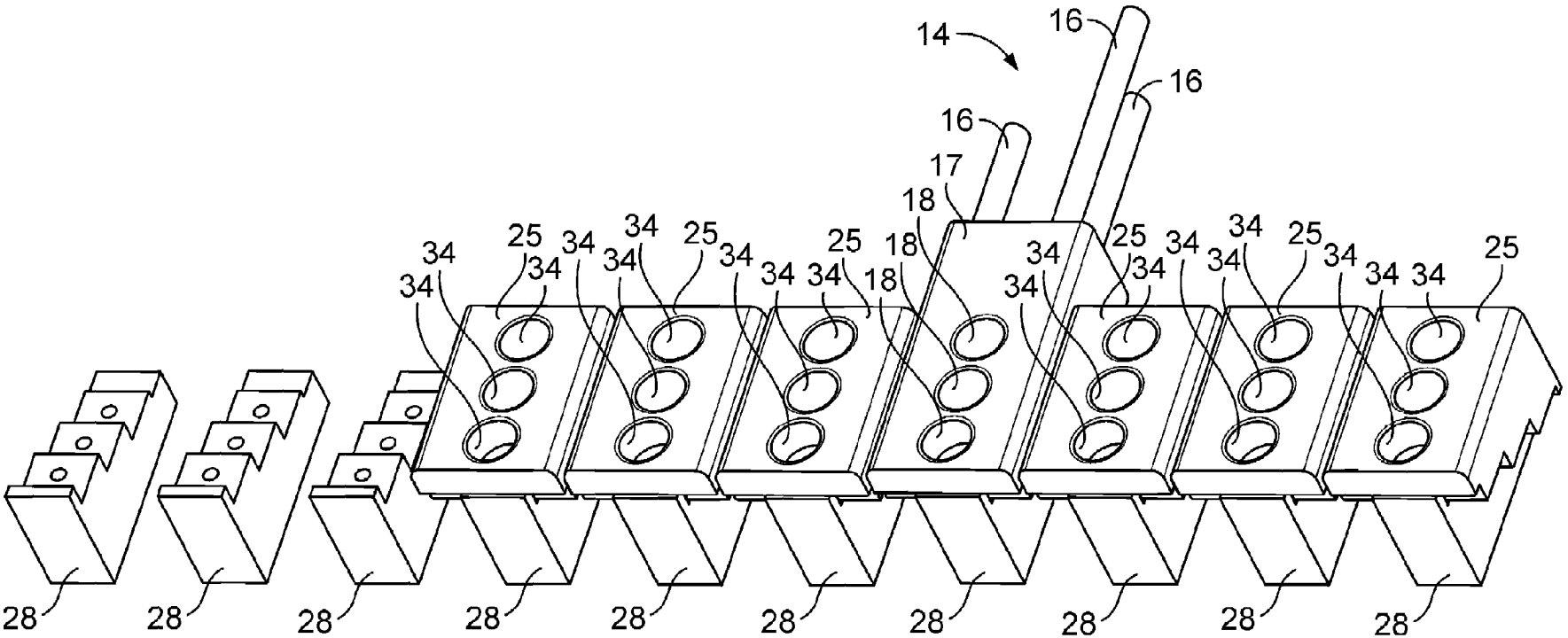
FIG. 23 illustrates a cable harness assembly disposed between multiple bridge assemblies.

FIG. 11 illustrates a bridge assembly 23 as it rests on the board-mounted connectors 28. Specifically, FIG. 11 illustrates a four-hole bridge assembly 23, comprised of three four-hole bus bars 12, and three bridge components 25, it is understood however, that any number of bridge components 25 and bus bars 12 can be used. FIG. 11 also illustrates the method in which the bridge assemblies 23 are assembled. The bridge assembly 23 is placed on the board-mounted connectors first, and then the screws (not shown) or other equipment are secured in the screw apertures 34. Next, as shown in FIG. 12, the cable harness 14 is placed on the remaining exposed portion 48 (FIG. 11) of the bus bar 12. Screws (not shown) or other equipment are placed in the screw apertures 34, which secure the cable harness 14 in place to the board-mounted connectors 28 and make an electrical connection between the terminals 56 of the cable assembly 14 and the bus bar 12. The screw heads (not shown) are recessed into the bridge components 25 and the cable harness 14 to ensure that no foreign objects can contact the screw heads to short out the electrical connection and cause damage to any portion of the apparatus. This arrangement of the cable harness 14 and bridge assembly 23 can be arranged and structured so that the cable harness 14 can be secured to the right of the bridge components 25 as shown in FIG. 13, or such that the cable harness 14 is secured to the left of the bridge components 25, as shown in FIG. 14, or somewhere in the middle, with bridge components 25 to either side of an open position 48 as shown in FIG. 23.

Figure 15:
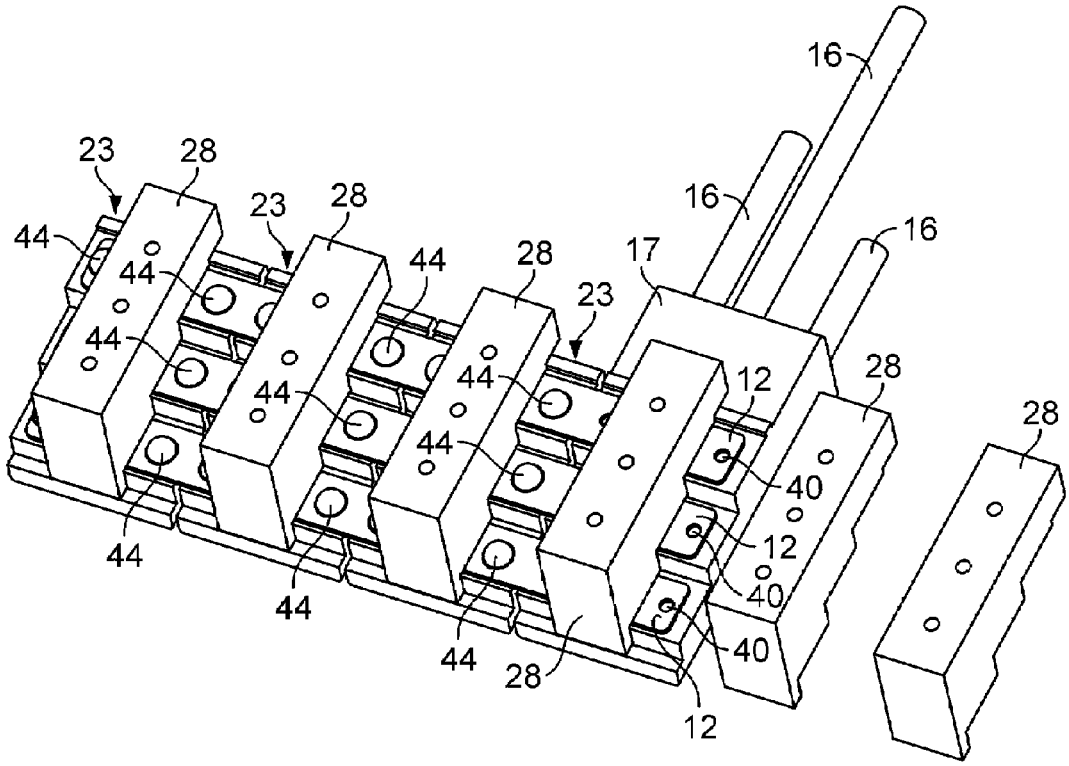
FIG. 15 is a view of the bus bar assembly from the view of the PC board.

FIG. 15 illustrates a board 46 view of the assembly 50. The board has been removed to illustrate the arrangement. FIG. 15 specifically illustrates a four-position assembly, however it is understood that any numbered position of assembly may be used. The screw apertures 38 of bus bars 12 are aligned with the screw apertures 30 of the board-mounted connectors 28. The caps 44 of the protrusions 42 can be seen between the board-mounted connectors 28, and are securing the bus bars 12 to the bridge components 25.

Figure 16:
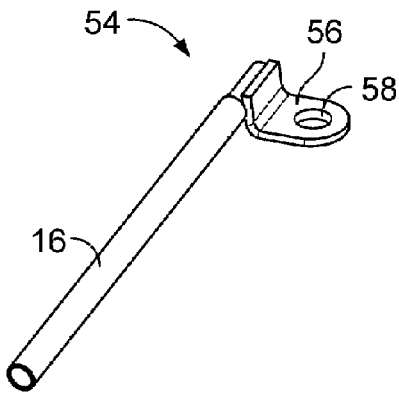
FIG. 16 is the left wire contact used in the cable harness assembly of the present invention.
Figure 17:
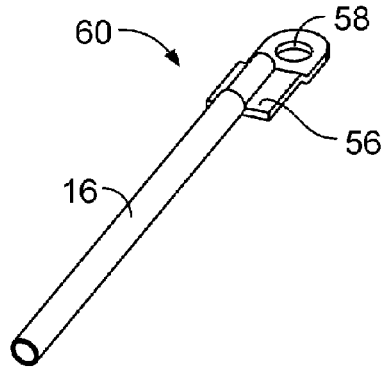
FIG. 17 is the center wire contact used in the cable harness assembly of the present invention.
Figure 18:
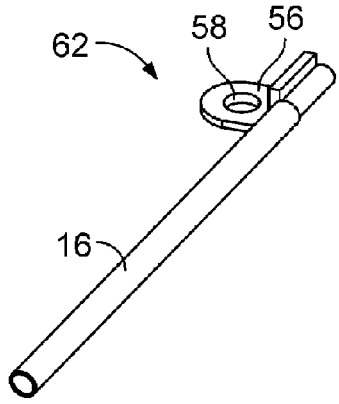
FIG. 18 is the right wire contact used in the cable harness assembly of the present invention.
Figure 19:
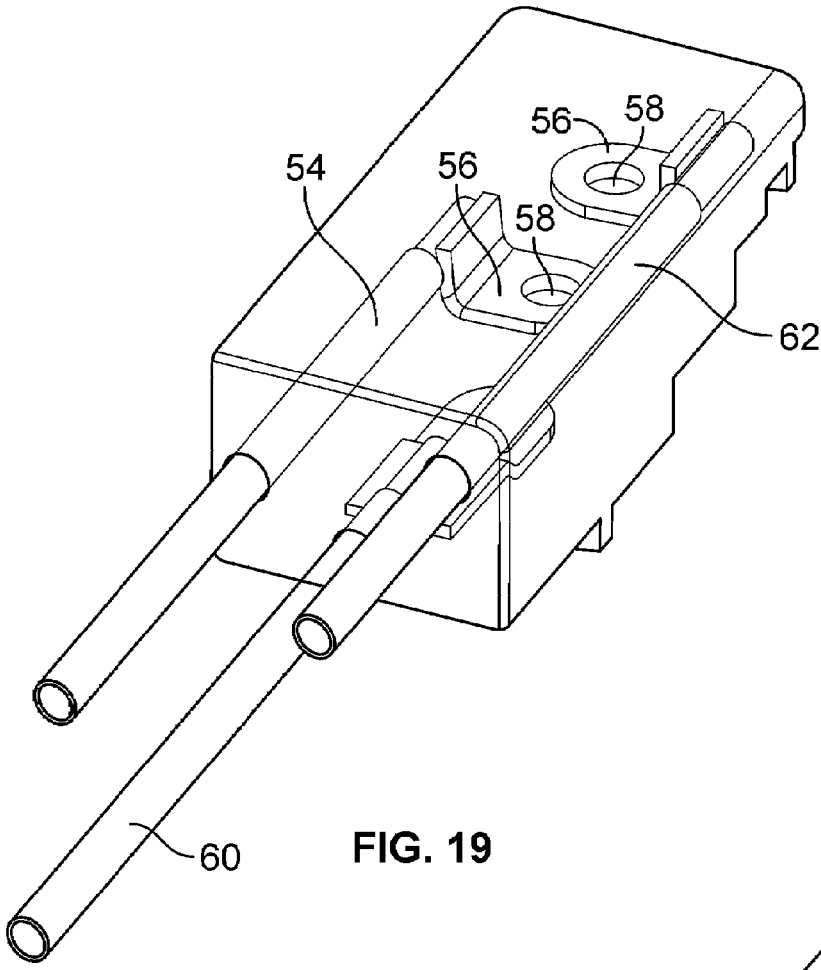
FIG. 19 illustrates the three cable assemblies as assembled in the cable harness assembly.

FIGS. 16, 17 and 18 illustrate the cable assemblies used within the cable harness (not shown). FIG. 16 illustrates the left cable assembly 54, which includes a wire 16 and a terminal 56. The terminal 56 is configured such that the wire 16 is to the left of the terminal 56. FIG. 17 illustrates the center cable assembly 60, which includes a wire 16 and a terminal 56 also. The terminal 56 is configured such that the wire 16 extends directly from the terminal 56. FIG. 18 illustrates the right cable assembly 62, which includes a wire 16 and a terminal 56. The terminal 56 is configured such that the wire is disposed to the right of the terminal 56. Each terminal 56 has an aperture 58, which is configured such that a screw or other equipment can fit through. The aperture 58 of the terminal 56 fits in alignment with the screw aperture 18 of the cable harness 14. Each terminal 56 is stamped from a suitable conductive material, preferably copper or a copper alloy material. The terminal 56 is then preferably plated with any other suitable conductive material, or combination of materials such as gold, silver, platinum, palladium, or nickel, although tin over nickel is preferred. FIG. 19 illustrates the cable assemblies 54, 60, 62 as arranged and disposed in the cable harness assembly 14. The right cable assembly 62 is disposed furthest back and in line with the first screw aperture 18. The wire 16 exits the cable harness 14 at a different elevation, put substantially parallel with respect to the other wires 16. The left assembly 54 is disposed in line with the second screw aperture 18. The wire 16 exits the cable harness below the wire 16 from the right cable assembly 62, but above the wire 16 from the center cable assembly 60. Alternately, the left cable assembly 54 and the right cable assembly 62 may be reversed, where the left cable assembly 54 is placed furthest back and in line with the first screw aperture and the right cable assembly 62 is placed in line with the second screw aperture 18. The center assembly 60 is disposed within the cable harness 14 in line with the third screw aperture 18. The wire 16 exits the cable harness below both the wires 16 from the right and left assemblies 62, 54. All three assemblies 54, 60, 62 are secured in their relative positions by overmolding insulative material around the assemblies 54, 60, 62, creating a cable harness 14. As a screw (not shown) or other equipment is placed inside the apertures 18, the screw forces contact between the terminals 56, and the bus bars 12 to create an electrical connection, and secures the cable harness 14 to the board-mounted connectors 28.

Figure 20:
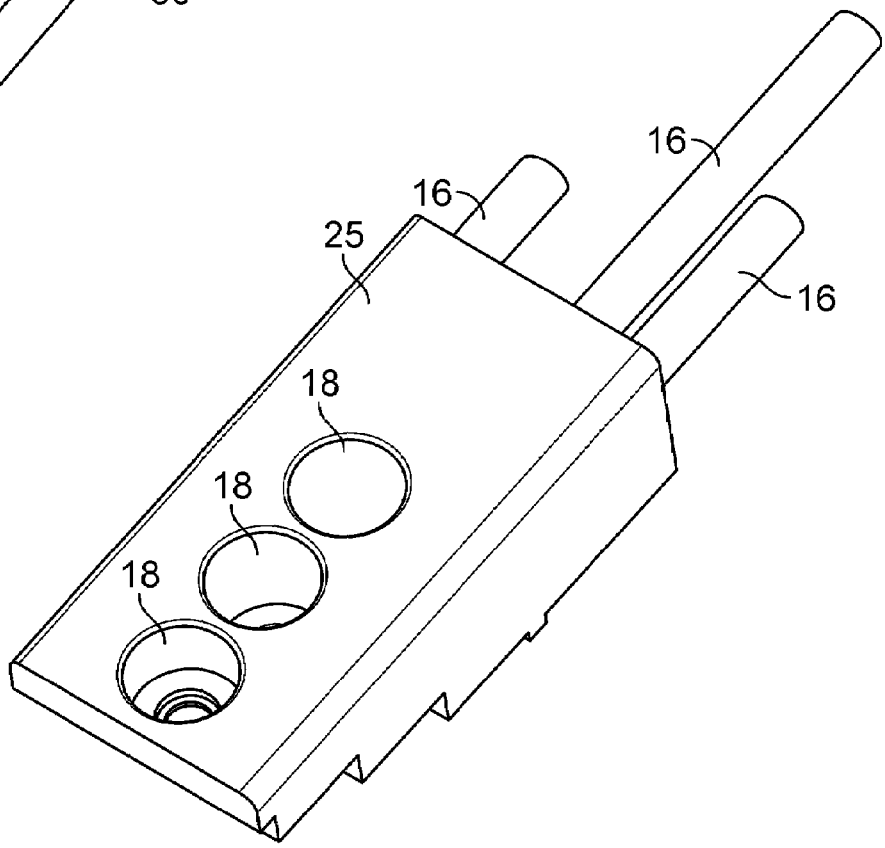
FIG. 20 illustrates the top view of the cable harness assembly.
Figure 21:
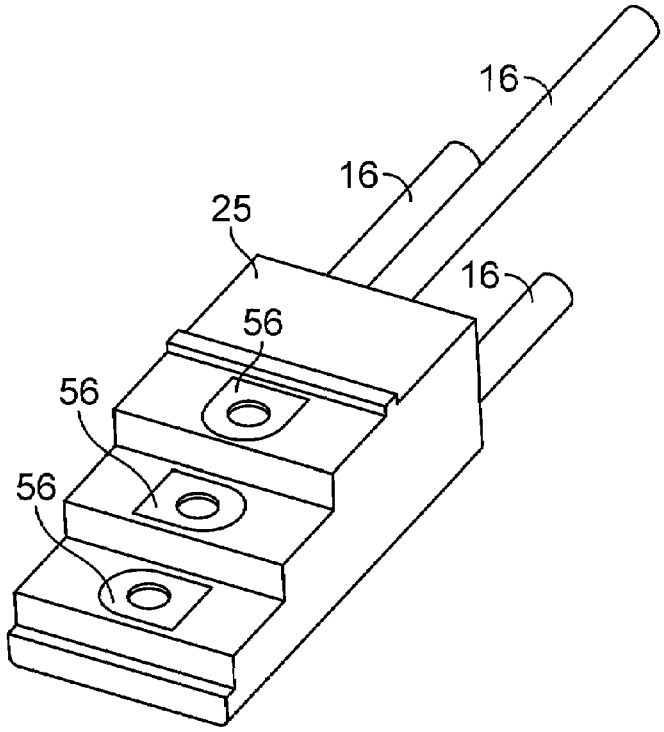
FIG. 21 illustrates the bottom view of the cable harness assembly.

FIG. 20 illustrates the cable harness assembly 14 in top view where the terminals 56 are shown being disposed in line with the screw aperture 18. The terminals 56 are exposed at the bottom of the screw aperture 18 having a rim 64 that allows a screw (not shown) or other equipment to make a solid electrical connection when in place. FIG. 21 illustrates the bottom view of the cable harness assembly 14. The terminals 56 of cable assemblies 54, 60, 62 are exposed on the bottom of the harness 14 to allow a solid electrical connection with the bus bars 12 that the harness 14 will rest upon when assembled to a bridge assembly. In this embodiment, the bottom of the harness 14 is shaped with steps in order to receive the shape of some board-mounted connectors (not shown) and to make solid connections with the bus bars (not shown). In other embodiments, steps may not be present. When the harness 14 with terminals 56 exposed is disposed on the board-mounted connectors, the bottom of the harness 14 rests either on the bus bars (not shown) that are lying on the board (not shown) or, in the case where a cable harness 14 is assembled to a single board-mounted connector 28 without being connected to a bridge assembly 23, terminals 56 of cable harness 14 will rest directly on, and be secured to the conductive members of board-mounted connector 28. The exposed terminals 56 are forced to make a solid connection with the bus bars (not shown) or conductive member of the board-mounted connector by virtue of the screw or other fastening device. The screw (not shown) or other equipment fits through the apertures 18 (FIG. 20), through the apertures 52 in the terminals 56 and through the bus bars (not shown) and into the conductive members of the board-mounted connectors (not shown). Not only does the screw (not shown) secure the harness 14 to the board-mounted connectors (not shown), but since the screw is electrically conductive, it also provides another means to electrically connect the bus bars (not shown) to the terminals 56, and therefore the wires 16. However, a non-conductive fastener could be substituted as long as a reliable connection between the bus bar and exposed portion of the plug assembly (shown in FIG. 21) is maintained by securing harness 14 to the bus bar.

Figure 22:
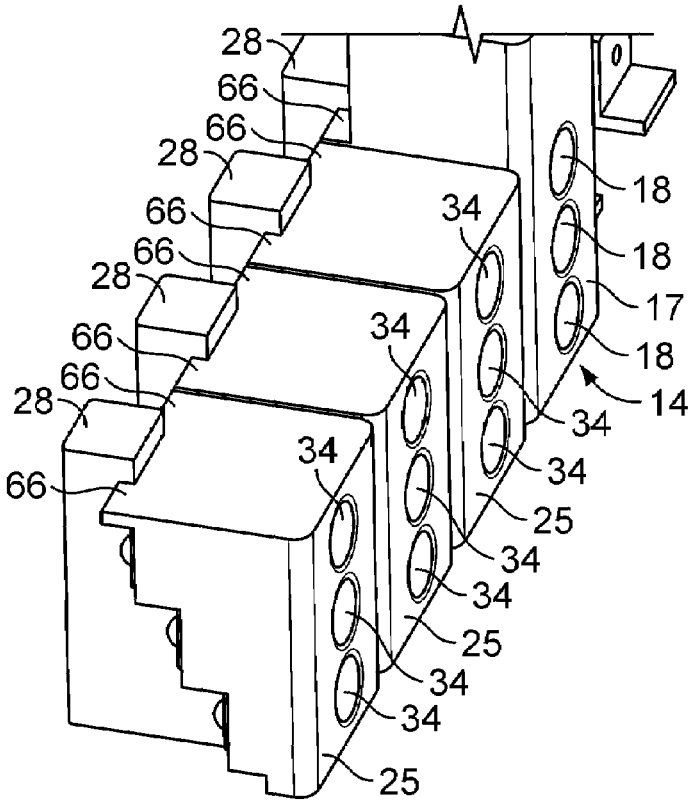
FIG. 22 illustrates the molded extensions on the present invention.

FIG. 22 illustrates an alternate embodiment of the present invention. By design, a small gap is present between adjacent bridge components 25 and cable harnesses 14 to allow for assembly tolerances and potential thermal expansion. Though it is not likely, small pieces of conductive material could pass through the gap, contact the bus bar assembly and cause an electrical short. The cable harness 14 and the bridge assemblies 23 may be constructed to have molded extensions 66 at the bottom to further eliminate any foreign object contact with the bus bars that are partially exposed on the underside of the bridge assemblies 23 and cable harness 14 or from entering the small gaps between the adjacent bridge assemblies 23 and cable harness 14. The molded extensions 66 extend past the board-mounted connectors 28 and create a shield or protection that prevents any foreign objects from being trapped between the board 46 and the bottom side of the bridge assembly 23 or cable harness 14. With the extensions, both the top and the bottom of the bus bars 12 are protected from foreign objects making contact and causing a short or other damage.

With the bridge and cable harness assembly in place, the bus bars are protected from foreign objects contacting and creating electrical shorts or other damage. The bridge and cable harness assemblies preferably are molded out of inexpensive plastic or other similar insulative material that is capable of sustaining heat generated by the bus bars without melting or deforming. They are easily assembled into place and easily replaced or removed as necessary. Thus, the bridge assembly and cable harness are inexpensive for manufacturing costs as well as assembly and replacement costs.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for terminating a bus bar assembly comprising:

a cable harness assembly including an insulative harness component, a plurality of conductive wires partially recessed within the insulative harness component, the wires having terminals on a bottom of the insulative harness component and extending from at least one side of the insulative harness component, a plurality of first apertures disposed along a top surface of the cable harness assembly for receiving a plurality of fasteners;

at least one bridge assembly including an insulative bridge component, a plurality of first apertures along a top surface of the at least one bridge assembly for receiving fasteners, a plurality of insulative protrusions extending away from the at least one bridge assembly, a plurality of bus bars disposed on a bottom of the at least one insulative bridge component, the plurality of insulative protrusions securing the plurality of bus bars along the bottom of the at least one insulative bridge component; and wherein the at least one bridge assembly partially covers the plurality of bus bars and the cable harness assembly is configured to cover an exposed portion of the plurality of bus bars, wherein the plurality of bus bars contacts the terminals on the bottom of the insulative harness component to create an electrically conductive connection.

2. The apparatus of claim 1 wherein the insulative harness component and insulative bridge component are manufactured from a plastic material.

3. The apparatus of claim 1 wherein the fasteners are screws.

4. The apparatus of claim 1 wherein the cable harness assembly and at least one insulative bridge component substantially cover the entire length of the plurality of bus bars.

5. The apparatus of claim 1 wherein the insulative harness component and insulative bridge component have extensions on the bottom surface that extend past a mounting arrangement.

6. The apparatus of claim 5 wherein the insulative harness component and extensions are a unitary piece, and wherein the insulative bridge component and extensions are a unitary piece.

7. The apparatus of claim 1 wherein the cable harness assembly is disposed to the right of the at least one bridge assembly.

8. The apparatus of claim 1 wherein the cable harness assembly is disposed to the left of the at least one bridge assembly.

9. The apparatus of claim 1 wherein the cable harness assembly is disposed between at least two bridge assemblies.

10. A method for manufacturing an apparatus for terminating a bus bar assembly comprising the steps of:

providing at least one bus bar assembly having an insulative bridge component, a plurality of first apertures disposed on a top surface for receiving fasteners, a plurality of insulative protrusions, a plurality of bus bars disposed on a bottom of the at least one insulative bridge component, wherein the plurality of insulative protrusions securing the plurality of bus bars to the bottom of the at least one insulative bridge component;

providing at least one insulating bridge assembly;

securing the at least one bridge assembly to the bus bar assembly with a plurality of fasteners, the at least one bridge assembly partially covering the plurality of bus bars and the cable harness assembly configured to cover an exposed portion of the plurality of bus bars, wherein the plurality of bus bars contacts the terminals on the bottom of the insulative harness component to create an electrically conductive connection;

providing a cable harness assembly having an insulative harness component, a plurality of conductive wires partially recessed within the insulative harness component having terminals on a bottom thereof extending from at least one side of the insulative harness component, and a plurality of first apertures disposed on a top surface for receiving a plurality of fasteners;

securing the cable harness assembly to the bus bar assembly; and wherein the insulating cable harness assembly and the at least one insulating bridge assembly substantially shields the bus bar assembly.

11. The method of claim 10 wherein the step of providing a cable harness assembly further comprises disposing the cable harness assembly to the right of the at least one bridge assembly.

12. The method of claim 10 wherein the step of providing a cable harness assembly further comprises disposing the cable harness assembly to the left of the at least one bridge assembly.

13. The method of claim 10 wherein the step of providing a cable harness assembly further comprises disposing the cable harness assembly between at least two bridge assemblies.

14. The method of claim 10 wherein the step of securing the cable harness assembly to the bus bar assembly further comprises having one of a plurality of fasteners and a plurality of protrusions.

* * * * *